US005188373A

United States Patent [19]

Ferguson et al.

[11] Patent Number: 5,188,373

[45] Date of Patent: Feb. 23, 1993

[54] HUNTING ARROW WITH SIGNAL GENERATING MEANS

[75] Inventors: Michael D. Ferguson, Rexburg; Ronnie R. Capson, St. Anthony, both of Id.

[73] Assignee: Sure Trak, Rexburg, Id.

[21] Appl. No.: 577,085

[22] Filed: Sep. 4, 1990

Related U.S. Application Data

[63] Continuation of Ser. No. 448,016, Dec. 7, 1989, abandoned, which is a continuation-in-part of Ser. No. 357,906, May 30, 1989, abandoned, which is a continuation-in-part of Ser. No. 205,478, Jun. 13, 1988, Pat. No. 4,858,935.

[51] Int. Cl.[5] ..... F42B 6/04

[52] U.S. Cl. ..... 273/421; 273/416

[58] Field of Search ..... 273/416, 418–423; 455/96, 98, 100, 66; 128/330, 903; 342/386; 43/6

[56] References Cited

U.S. PATENT DOCUMENTS

| | | | |
|---|---|---|---|
| 2,289,284 | 7/1942 | Chandler | 273/421 X |
| 2,519,553 | 8/1950 | Faulkner | 350/17 |
| 2,907,327 | 10/1959 | White | 128/217 |
| 2,925,278 | 2/1960 | Sweetland | 273/421 X |
| 3,759,519 | 9/1973 | Palma | 273/416 |
| 3,790,948 | 2/1974 | Ratkovich | 343/113 |
| 3,893,866 | 7/1975 | Hollingsworth | 273/106 |
| 3,976,298 | 8/1976 | Hinchman | 273/420 |
| 4,230,322 | 10/1980 | Bottelsen | 273/420 |
| 4,405,133 | 9/1983 | Cartwright, Jr. | 273/422 X |
| 4,421,319 | 12/1983 | Murphy | 273/416 |
| 4,597,580 | 7/1986 | Gassie | 273/418 |
| 4,651,999 | 3/1987 | Sturm | 273/416 |
| 4,675,683 | 6/1987 | Robinson et al. | 342/386 |
| 4,700,692 | 10/1987 | Baumbartner | 128/1.2 |
| 4,704,612 | 11/1987 | Boy et al. | 342/386 |
| 4,744,347 | 5/1988 | Dodge | 124/86 |
| 4,749,198 | 6/1988 | Brailean | 273/416 |
| 4,858,935 | 8/1989 | Capson | 273/416 |
| 4,940,245 | 7/1990 | Bittle, Jr. | 342/386 X |
| 4,976,442 | 12/1990 | Treadway | 273/416 |

*Primary Examiner*—Paul E. Shapiro

*Attorney, Agent, or Firm*—Thorpe, North & Western

[57] ABSTRACT

A hunting arrow especially adapted to release a transmitter into a quarry animal to enable location of the quarry after having been shot. Preferably, the transmitter is secured to the hide of the quarry without substantial penetration into the animal. The device is particularly useful in the event that the hunting arrow passes completely through the quarry, or if imbedded therein is broken off or pulled out by the quarry. The arrow may be provided in two slidably engaged parts, with the transmitter releasably retained therein. An attachment device may be provided to remove the transmitter from the arrow and attach it to the quarry. Alternatively, the transmitter may be releasably secured to the outside of the arrow and released upon impact with the target animal.

7 Claims, 9 Drawing Sheets

HUNTING ARROW WITH SIGNAL GENERATING MEANS

This application is a continuation-in-part of application Ser. No. 07/448,016, filed Dec. 7, 1989, abandoned, which is a continuation-in-part of application Ser. No. 07/357,906, filed May 30, 1989, abandoned which is a continuation-in-part of application Ser. No. 07/205,478, filed Jun. 6, 1988, which issued as U.S. Pat. No. 4,858,935 on Aug. 22, 1989.

BACKGROUND OF THE INVENTION

The present invention relates to a hunting arrow, and more specifically to a hunting arrow having signal generating means, in the form of a transmitter, located either on or within the arrow to enable a bow hunter to locate the arrow after a missed shot, or the wounded animal after a successful shot independent of the location of the arrow.

The bow hunting of big game animals is increasing in popularity in the United States. White-tailed deer, mule deer, elk, antelope and bear are only a few of the species currently being hunted. State-of-the-art hunting arrows typically have a hollow fiber-glass or aluminum shaft and are provided with a removable and interchangeable tip, or "broadhead". The type, size, weight, etc., of a broadhead may be changed depending upon the animal hunted, the weather conditions, the terrain, etc. Such arrows are quite expensive, typically ranging in price from $5.00 to $7.00.

Two distinct problems are common with bow hunters: (1) locating the arrow resulting from a missed shot and (2) locating the injured animal (if an immediate kill is not made) resulting from a successful shot. Even the best of hunters miss their target about 20–25% of the time, and less experienced hunters even more. When shooting from a range of 50–100 yards, it is not uncommon to lose the arrows resulting from errant shots. A typical hunter may lose 10–20 arrows per year, resulting in substantial financial loss. Even more importantly, however, the loss of game resulting from successful shots is significant. While it is possible to drop a smaller animal immediately with a well-placed shot, larger animals such as deer, elk, bear, etc., are seldom instantly killed by an arrow. Whether the arrow passes completely through the animal or remains imbedded therein, the animal may run for from a few hundred yards to two miles before either dying or resting.

Hunting arrows have been developed which contain transmitters, enabling the bow hunter with a receiving unit to locate either the arrow after an errant shot, or the quarry after a successful shot, presuming the arrow remains imbedded in the quarry. For instance, U.S. Pat. No. 3,790,948 discloses a battery-powered transmitter located within the broadhead and having a rigid antenna extending through the shaft of the arrow. The arrow of U.S. Pat. No. 4,421,319 includes a transmitting device located in the nock of the arrow. The device may also include an audible signal generator to further aid location of the arrow. U.S. Pat. No. 4,675,683 discloses a transmitter positioned intermediate the arrowhead and the nock of a hunting arrow. The transmitter is provided as an extension of the arrow between the main body of the arrow and the arrowhead. The shaft of the arrow serves as the antenna for the transmitter and the transmitter remains with the arrow at all times.

The foregoing patents have addressed the problem of errant shots and successful shots wherein the arrow remains imbedded in the quarry, but in a significant number of cases of successful shots in relatively smaller animals (such as white-tail deer) the arrow passes completely through the animal, severely injuring but not necessarily immediately incapacitating it. If imbedded, the arrow is usually broken off against trees, rocks, etc., or pulled out by the injured animal. In such cases the animal may run a substantial distance before dying, making it quite difficult to find, even if one of the arrows of the prior art is utilized.

SUMMARY OF THE INVENTION

Accordingly, the present invention provides a means for emplacing a signal generating device (or transmitter) within the quarry so that in the event the arrow passes completely through the quarry, or is pulled out of the animal or broken off by the animal, the transmitter will remain with the quarry, enabling it to be located by a corresponding receiver.

Therefore, the arrow of the present invention, in its broadest embodiment, is provided with a releasable signal generating means which is released from the arrow either inside the target animal or is attached to the hide of the animal when hit by the inventive arrow. As disclosed herein, a number of different embodiments may be utilized. In one embodiment, the arrow comprises a two-part arrow, the forward and rearward portions in sliding or telescoping relationship to one another. Alternatively, a sleeve may be provided to join the forward and rearward portions. A transmitter is disposed within the arrow, and attaching means are provided on the transmitter to assure attachment either to the hide of the animal or to internal organs within the animal. The transmitter is provided with an elongate, flexible antenna, the length of which is sufficient to extend outside the animal when the transmitter is imbedded therein.

In another embodiment, the transmitter is releasably affixed external to the hunting arrow shaft. Means affixing the transmitter to the shaft have sufficient strength to withstand the accelerative force of shooting the arrow, but not sufficient to withstand the impact of the transmitter with the hide of the target animal. Preferably, some sort of barbed hook to ensure attachment to the animal hide, is provided.

Other embodiments are possible which will eject the transmitter within the target animal. Such embodiments may comprise an extension onto the forward end of a conventional hunting arrow. The extension will be provided with a chamber within which the transmitter is emplaced. The transmitter is provided with an elongate, flexible antenna which is disposed either within the arrow shaft or within the chamber. The arrow is provided with means to releasably retain the transmitter within the chamber, which permits its ejection within the quarry. Finally, means to eject the transmitter from the chamber are provided.

In a further embodiment, the chamber is provided as a "window" in the arrow shaft, or an extension to the shaft, the chamber being provided with an end wall at the forwardmost end of the chamber and an outwardly sloping end wall at the rearward end of the chamber. Alternatively, the sloping end wall may be located at the forward end of the chamber to permit a forward, rather than a rearward, ejection of the transmitter. The transmitter may be spring-loaded within the chamber, and retained therein by a moveable sleeve positioned over the chamber, which slides longitudinally along the arrow shaft. Upon striking the quarry, the broadhead enters the animal and the sleeve is preferentially retained either by the hide of the animal or some internal organ, and slides rearwardly along the arrow shaft. After sliding rearwardly a sufficient distance to expose the chamber, the transmitter is "ejected" into the body cavity of the quarry by the spring bearing against the forward-most end wall. As the arrow travels through the animal, the antenna is withdrawn from the arrow. After passing completely through the animal, the antenna may protrude from the exit wound of the quarry. In any event, the transmitter is imbedded within the quarry and can be easily tracked with an appropriate receiving unit.

In further embodiments the window in the arrow shaft may remain open without a movable sleeve positioned over the transmitter chamber. In this embodiment, means are provided to restrain the transmitter within the chamber until arrow impact and the consequent deceleration force.

In still further embodiments, restraining means may be provided consisting of a spring means compressed between a rearward portion of the arrow shaft and a leading edge of the transmitter. The transmitter is held in position within the chamber by means of a spring-loaded pin which extends through the transmitter assembly. A lower end of the pin extends through an aperture in the arrow chamber. The transmitter is held within the chamber due to frictional engagement between the lower end of the pin and the chamber aperture. This frictional engagement is sufficient to overcome the action of the upward spring loading on the pin which tends to force the pin up and disengage the chamber aperture. After arrow impact, the pin frictional force is released due to forward motion of the transmitter and the spring means forces the transmitter backwards, up the ramp and out of the chamber.

In another embodiment, retraining means in the form of an O-ring or similar device may be secured about a forward portion of the transmitter such that the O-ring grips the transmitter assembly with an inner surface and grips the inner surface of the arrow chamber with the O-ring outer surface. The transmitter is provided with a barbed hook and exits the chamber via a ramp within the chamber when the barbed hook engages an animal hide. The gripping force of the O-ring on the chamber surface must be sufficient to retain the transmitter within the chamber during the arrow acceleration period.

In another embodiment, restraining means in the form of a cam member having an arcuate bearing surface maintains the transmitter within the arrow. Compression means forces the arcuate bearing surface of the cam to engage a rear portion of the transmitter, and retain the transmitter within the arrow. Upon arrow impact, a barbed hook affixed to the transmitter engages the animal and puts an "upward" force on the transmitter. As the transmitter moves upwardly (outwardly), about an eccentrically located pivot pin. The cam raises the rear of the transmitter and the barbed hook, restrains the transmitter as the compression means forces the transmitter back and out the chamber opening.

Each of these embodiments may be further enhanced by providing the transmitter assembly and chamber within a separable section or extension of the arrow that may be threadably engaged between the broadhead and the main shaft of the arrow. In this arrangement the three parts (the main arrow body with nock and fletchings, the extension and the broadhead) become exchangeable. Replacement of the extension is easier and less expensive than replacement of the arrow, and relieves the owner of rebuilding the fletchings which often are hand-crafted by the archer. The extensions are shorter and more portable, and may be carried in a "fanny pack" rather than carrying replacement arrows in a quiver. Another similar attachment means utilizes an interference fit between a plastic insert held within the chamber and a head portion of the transmitter.

In another preferred embodiment, the extension is rigidly mounted to the broadhead in order to eliminate the possibility of misalignment of the broadhead on the extension, perhaps due to damaged threads. The one-piece rigidly mounted broadhead can be made shorter and, therefore, lighter than the two-piece assemblies. A typical weight saving is on the order of 70 grains (0.08 oz.). This represents an approximate 25% weight savings over the combined weight of the broadhead and separate extension where the weight of the broadhead and extension typically is about 260 grains (0.6 oz.). Not only is this model lighter and shorter, 4 inches versus 7.75 inches, but it is easier to fabricate since both the male and female threads are eliminated from the broadhead and extension, respectively. The result is a more accurate, lighter, and less expensive radio transmitter arrow.

Finally, locating the barb at the back end of the transmitter has a further advantage of providing a constant temperature after the transmitter is lodged within the animal, thereby avoiding radio transmitter frequency shifts eliminating the need for a tuning receiver.

The transmitter utilized herein may be actuated manually prior to making the shot, automatically actuated upon release of the arrow from the drawn bow string or upon impact with the quarry. Preferably, the transmitter generates a pulsating signal which may be received at distances of up to two miles.

DETAILED DESCRIPTION OF THE INVENTION

Figure 1:
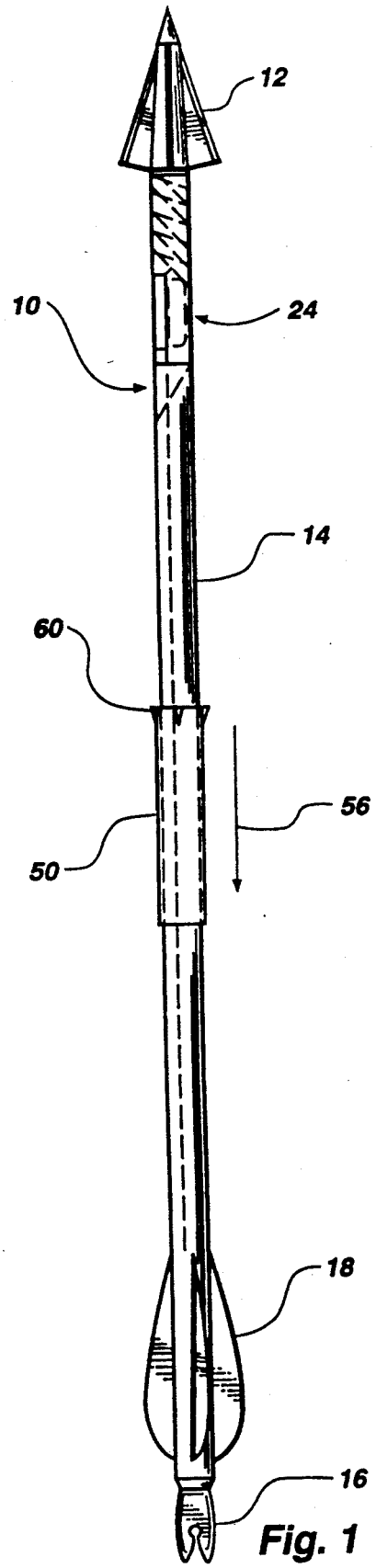
FIG. 1 is a plan view, in partial sectional view, of a hunting arrow of the present invention.
Figure 2:
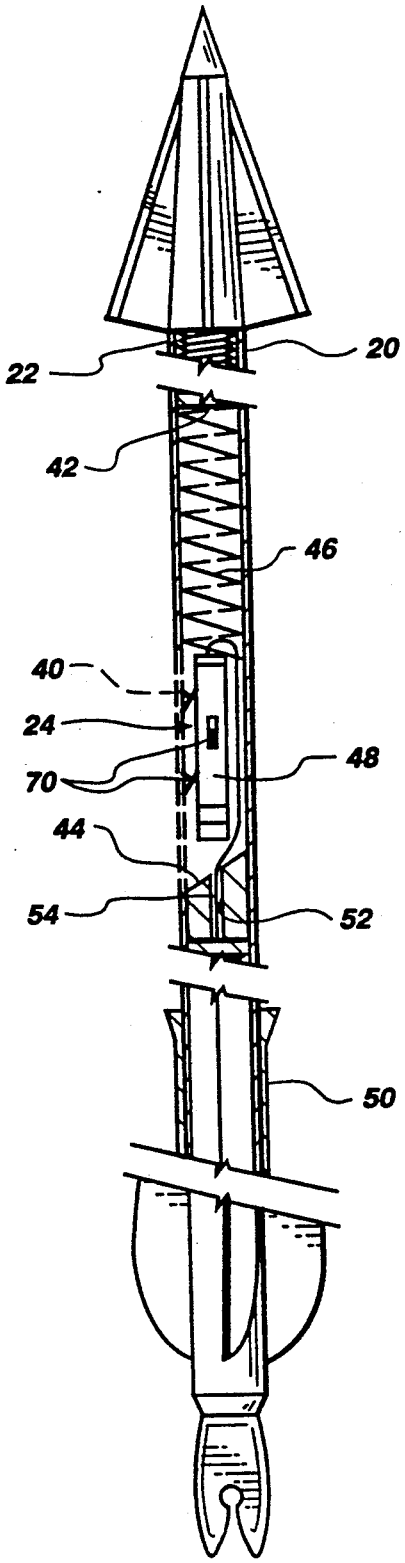
FIG. 2 is an enlarged partial sectional view of the hunting arrow of the present invention.

FIG. 1 illustrates a hunting arrow generally designated 10, having a broadhead 12, shaft 14, nock 16, and fletchings 18. As illustrated in FIG. 2, the broadhead 12 is removably affixed to shaft 14 to permit the interchange of various broadheads depending upon the particular conditions. For instance, the broadhead may be affixed as by screwing the broadhead with threaded male member 20 into threaded female plug 22 affixed in the forward-most end of shaft 14. The transmitter of the present invention, designated 24, may advantageously be interposed as an extension between broadhead 12 and shaft 14. The extension of the present invention may be threaded in the same manner as shown in 20, 22 of FIG. 2.

As shown more specifically in FIG. 2, hollow shaft 14 of arrow 10 may be provided with a signal generating means of the present invention. A "window" 40 may be provided within the shaft 14 rearward of plug 22. The window may simply be milled into the shaft of a conventional arrow. A forward wall 42, in the form of a plug, is placed forward of window 40. A rearward wall 44 is emplaced beneath a rearward portion of window 40. Spring member 46 biases the signal generating means (transmitter) 48 against sleeve 50 (shown in the "retracted" position in both FIGS. 1 and 2). An aperture 52 in rearward wall 44 permits antenna 54 to be disposed throughout the length of arrow shaft 14.

In a first embodiment, the spring member 46 biases transmitter 48 against the sloped wall 44 and against sleeve 50. While antenna 54 may be coiled within the window 40, the antenna may also be disposed throughout the length of the arrow through aperture 52. The plug 42 may be either glued in place or may be sized to maintain its position by friction. The plug 44 may likewise be glued or frictionally engaged within the window 40.

While the invention has been described above to eject the transmitter in a rearward direction, it should be appreciated that the location of walls 42, 44 can be reversed so that the transmitter is ejected forwardly rather than rearwardly.

Figure 3:
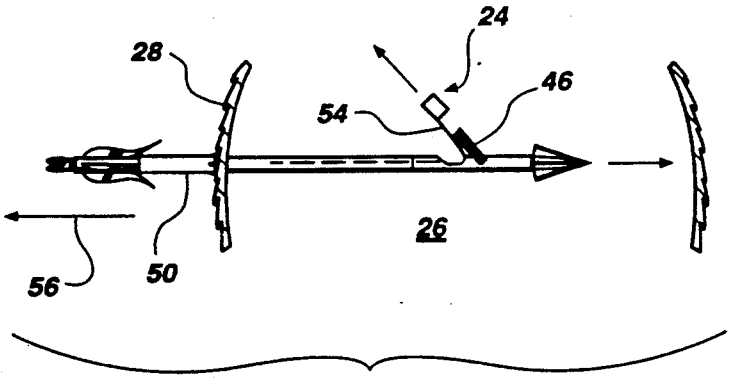
FIG. 3 is a pictorial view of the hunting arrow of FIG. 1 entering a target animal.
Figure 4:
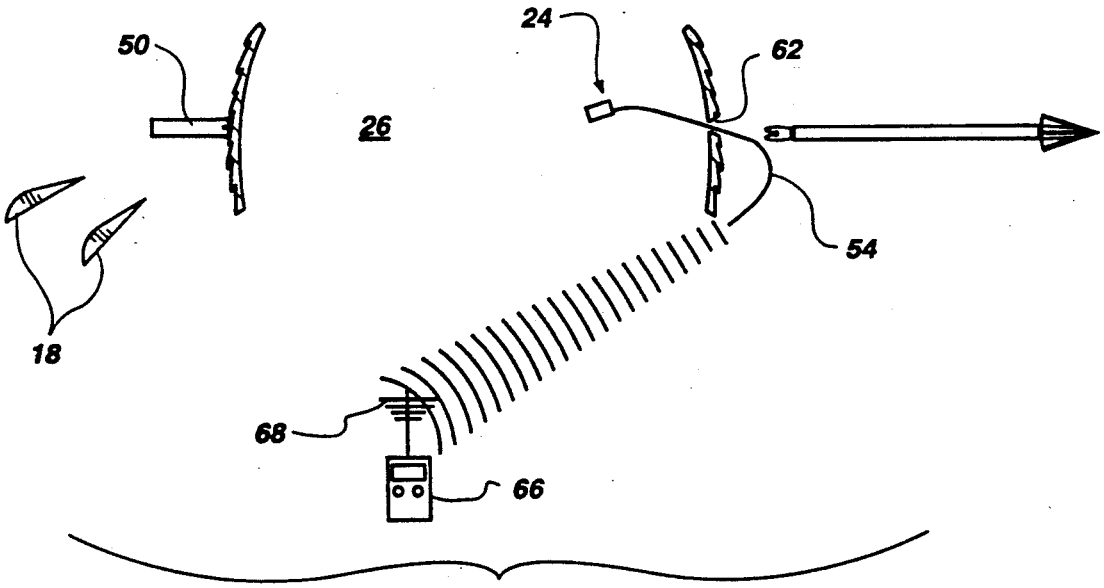
FIG. 4 is a pictorial view of a transmitter and receiver of the present invention.

The operation of the embodiment illustrated in FIG. 1 is as follows: As the arrow enters the target animal 26 (FIG. 3), sleeve member 50, protruding somewhat from the smooth surface of arrow shaft 14 and slidably engaged therewith, is retained somewhat either by the hide 28 of the animal or viscera, bones, etc. In any event, the sleeve 50 is moved rearwardly along shaft 14 in the direction of arrow 56. As sleeve 50 moves rearwardly, the transmitter is "ejected" from the interior of shaft 14 by spring member 46 and into the body cavity of the target animal. In order to facilitate the opening of window 40, barbs or hooks 60 may be provided on sleeve 50 to ensure its emplacement with the quarry and relative non-movement with respect to arrow 10. Likewise, barbs or hooks 70 may be provided on the transmitter 48 so that it "catches" internally within the quarry to ensure proper retention therein. As the arrow continues its movement through the quarry, antenna 54 is pulled from the arrow, and may protrude through the exit wound 62 in the quarry.

Figure 5:
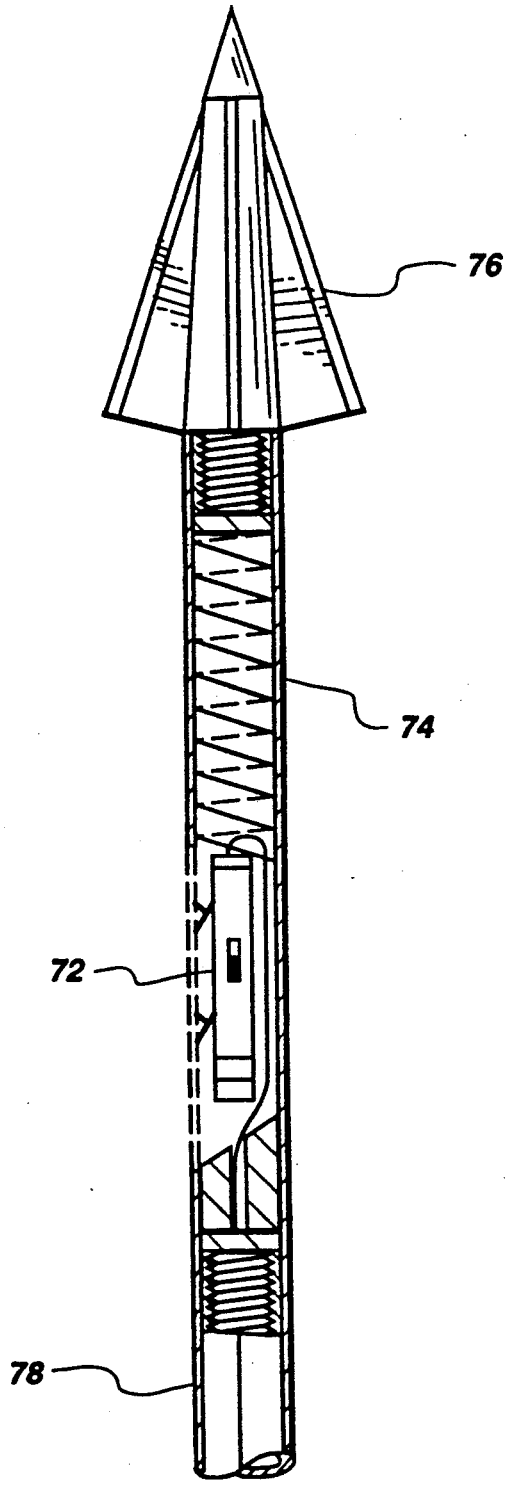
FIG. 5 is a plan view of a second embodiment of the present invention.

An alternative embodiment illustrated in FIG. 5 of the invention of FIG. 1 is to provide the transmitter 72 in an extension 74 which may be interposed between a conventional broadhead 76 and arrow shaft 78. In such embodiment, a consumer need not purchase an entire arrow but rather only the extension containing the transmitter and ejection means. The method of disposing the antenna throughout the length of the arrow, as shown in FIGS. 1 and 2 could be employed in this embodiment. Alternatively, the antenna could be coiled within the window of the extension.

Figure 6:
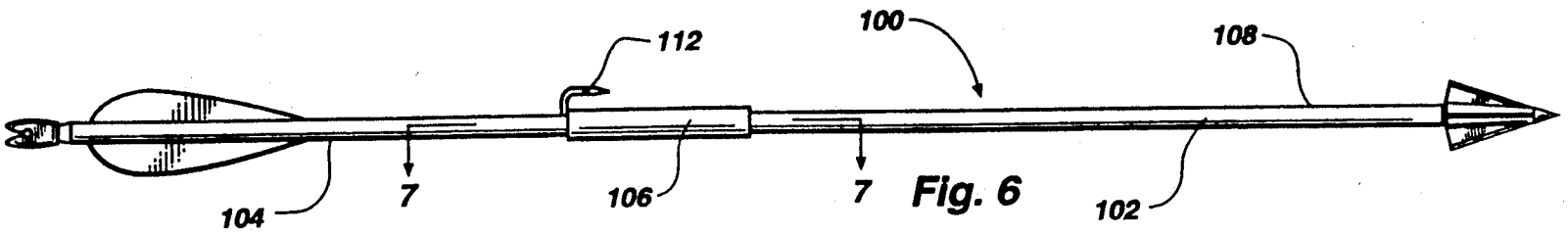
FIG. 6 is a plan view of another embodiment of a hunting arrow of the present invention.

Another embodiment of the invention is illustrated in FIG. 6. The arrow, generally designated 100 comprises a forward portion 102, a rearward portion 104 and a sleeve 106 interconnecting the forward and rearward portions. As illustrated more particularly in FIG. 7, the rearward portion 104 is provided with a transmitter 108 therein, the transmitter having an elongate, flexible antenna 110 affixed thereto. Preferably, the antenna is coiled within the shaft of the arrow 100 so that upon release of the transmitter, the antenna may be elongated when uncoiled. Means to separate the transmitter from the hunting arrow are provided, such as the barbed hook 112.

Figure 8:
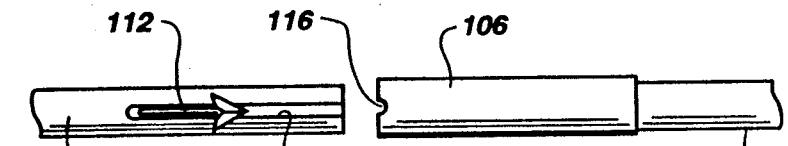
FIG. 8 is an exploded view of the arrow of FIG. 6.

FIG. 8 illustrates the arrow 100 with the forward portion 102 separated from the rearward portion 104. The sleeve 106 is securely affixed to the forward portion 102 and has an inside diameter sufficient to retain the rearward portion 104 by frictional engagement. The rearward portion may be provided with a slot 114 sized to permit the hook 112 to slide therethrough. The sleeve may be provided with a notch 116 to permit the sleeve to engage the hook 112 when in the position of FIG. 6. Such engagement prevents rotational movement of the front portion 102 of the arrow.

Figure 9:
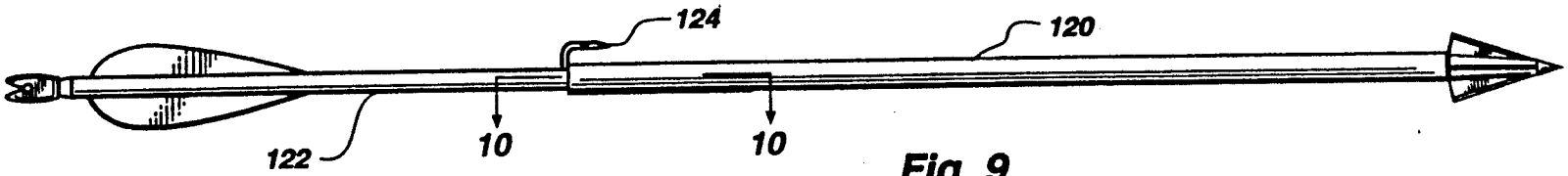
FIG. 9 is a plan view of another embodiment of a hunting arrow of the present invention.
Figure 10:
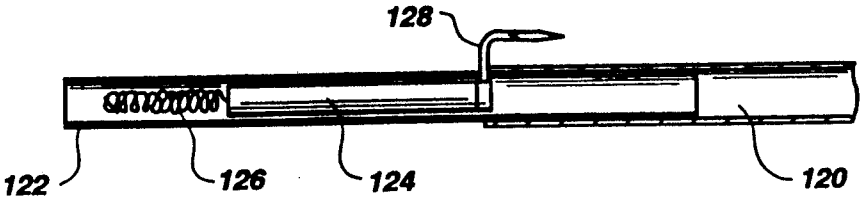
FIG. 10 is a sectional view of the arrow of FIG. 9 taken along lines 10—10.

Alternatively, the hunting arrow may be provided with telescoping forward 120 and rearward 122 portions of different diameters. As illustrated in FIG. 9, the rearward portion is of smaller diameter than the forward portion and is frictionally engaged within the forward portion. Such engagement is sufficient to prevent unintended separation of the parts, but not so great as to prevent separation when the arrow strikes a target animal. A transmitter 124 (FIG. 10) having an elongate, flexible antenna 126 and hook 128 as in FIG. 6 is disposed within the rearward portion 122. The rearward portion 122 may be constructed identically with that illustrated in FIG. 8, the difference being that the forward portion 120 is provided with a diameter equal to that of the sleeve 106 of FIGS. 6–8.

Figure 11A:
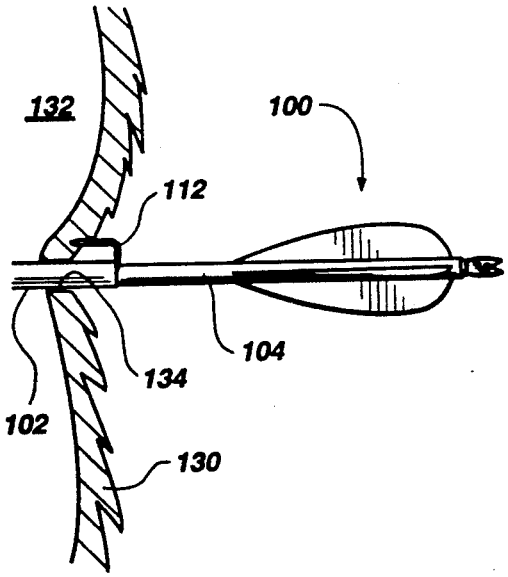
FIG. 11 *a–d* are a pictorial view of the hunting arrow of FIG. 6 entering a target animal.

In all of FIGS. 6–10, the method of releasing the transmitter from the arrow is the same. Such method is disclosed in FIGS. 11*a–d*. FIG. 11*a* illustrates the arrow 100 of FIG. 6. As the forward portion 102 enters the hide 130 of a target animal 132, an entry wound 134 is produced. As the arrow moves further into the animal, the barbed hook 112 prevents further forward movement of the rearward portion 104 of the arrow. The forward and rearward portions separate (FIG. 11*b*), with the forward portion 102 continuing its forward movement, either being retained within the animal or passing completely through the animal. The transmitter 108 is loosely retained within the rearward portion 104 and as the animal runs away, the rocking motion of the rearward portion 104 causes it to fall away (FIG. 11*c*), enabling the antenna 110 to be elongated (FIG. 11*d*) and the signal 136 to be broadcast from the transmitter for receipt by a receiving unit (not shown). As illustrated in FIG. 11, the transmitter is retained either on the outside of the target animal, or just within the target animal, enabling the antenna to be exterior of the animal, and thereby increasing the strength of the signal broadcast by the transmitter.

Figure 7:
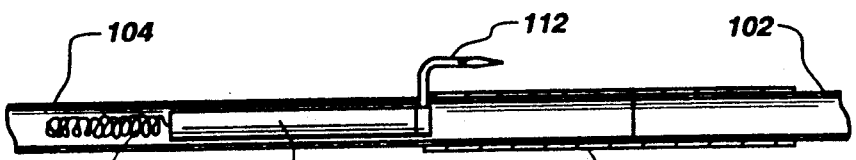
FIG. 7 is a sectional view of the arrow of FIG. 5 taken along lines 7—7.
Figure 11B:
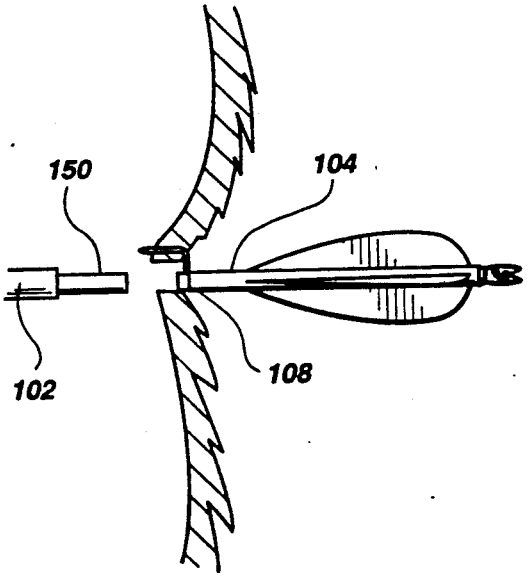
Figure 11C:
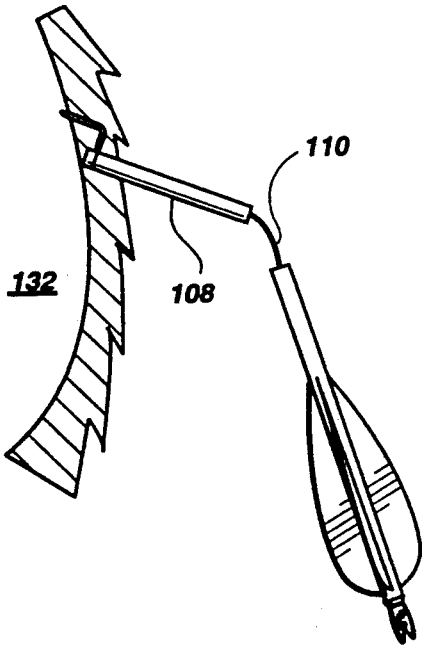

The sleeve 106 is illustrated in FIGS. 6–8 as external the forward and rearward portions of the arrow. It is to be appreciated that as used herein, the word "sleeve" is meant to encompass any external or internal device connecting the forward and rearward portions of the arrow. Therefore, the sleeve could be provided in the nature of a plug 150 (as shown in FIG. 11*b*) engaging the interior surfaces of the forward and rearward portions rather than the exterior surfaces.

Figure 11D:
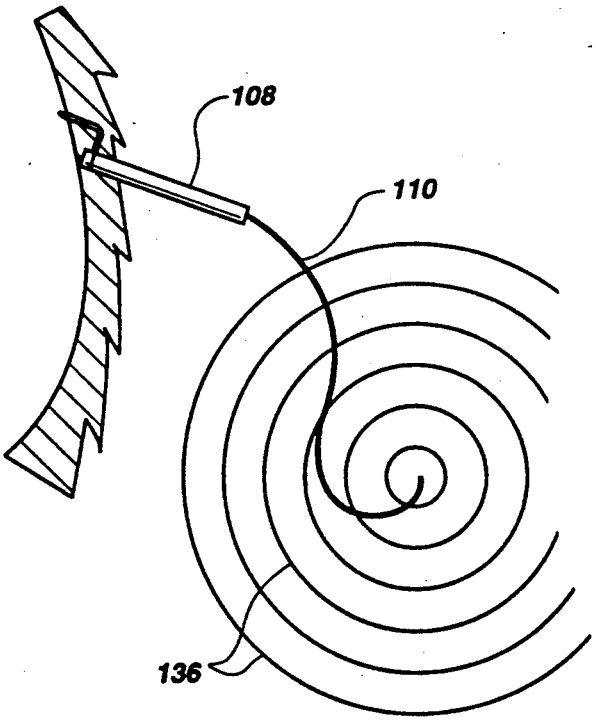
Figure 12:
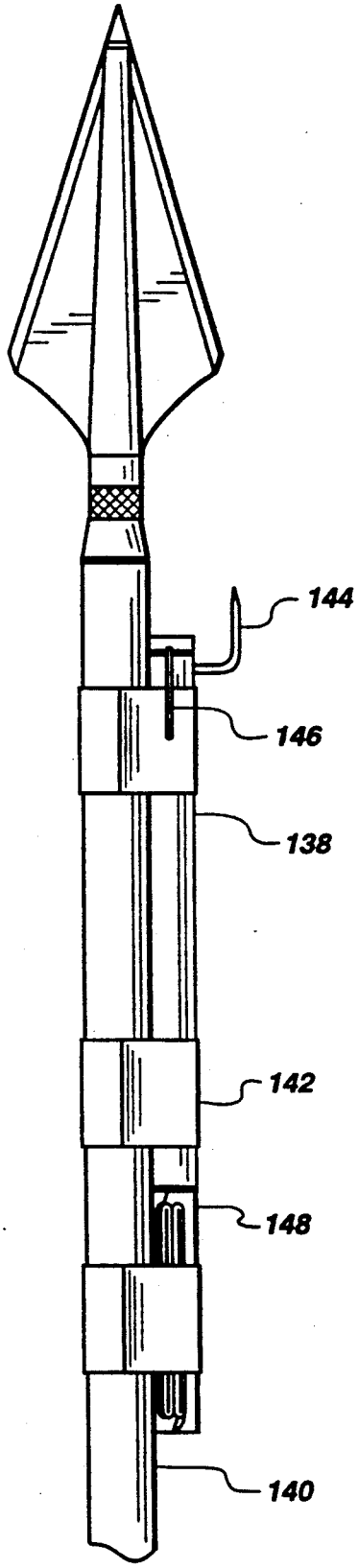
FIG. 12 is a partial plan view of another embodiment of a hunting arrow of the present invention.

FIG. 12 illustrates a further embodiment of the invention. In this embodiment, the transmitter 138 is secured to the arrow 140 by releasable attaching means 142. Such means 142 may advantageously be provided in the form of tape having sufficient bonding or shear strength to maintain the transmitter affixed to the arrow in view of the forces applied to the transmitter when the arrow is shot, but not sufficient to withstand the impact of the transmitter against the hide of the target animal. The transmitter is provided with attaching means in the form of either barbed hooks 144 or simple spring-loaded barbs 146 to secure the transmitter to the hide of the target animal. A coiled antenna 148 is affixed to the rear portion of the transmitter 138 for deployment as in FIG. 11. In the embodiment of FIG. 12, the arrow is a one-piece arrow rather than a two-piece arrow, but the transmitter is affixed to and retained on the hide of the target animal in the manner illustrated in FIG. 11.

Figure 13:
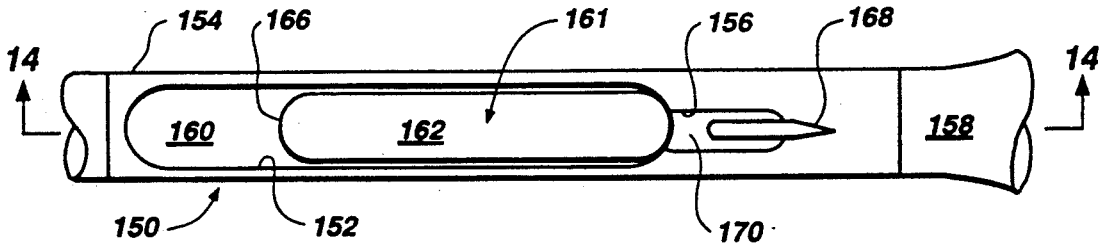
FIG. 13 is a partial plan view of an extension of a hunting arrow of the present invention.
Figure 14:
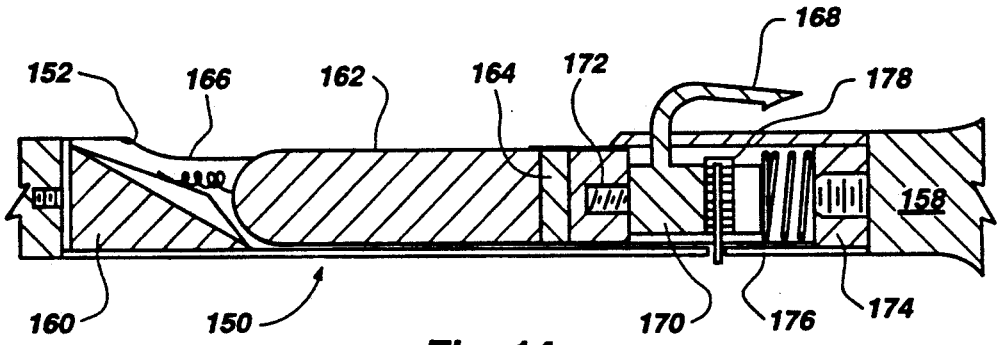
FIG. 14 is a sectional view of the extension of FIG. 13 taken along lines 14—14.

In still a further embodiment, FIGS. 13 and 14 illustrate an arrow 150 having a window 152 provided in the shaft 154. The window 152 has a narrow extension 156 protruding forwardly toward the broadhead 158.

Within the arrow 150 is a ramp 160 which underlies a rearward portion of the window 152. The ramp 160 is secured within the arrow, as with adhesive, by friction or other means well-known to those skilled in the art. Retained within the arrow, forward of the ramp 160 is a transmitter assembly, generally designated 161, which includes a transmitter 162, battery 164 and an antenna 166. Further, attaching means 168, in the form of a barbed hook, is secured to a forward portion 170 of the assembly 161, which is in turn secured to the transmitter 162, as by threaded member 172. A plug 174 in the forwardmost portion of arrow 150 receives broadhead 158. Spring means 176 bears against a rearward portion of plug 174 and against a leading edge of the forward portion 170.

The transmitter assembly is secured within the arrow by a spring-loaded pin 178 which extends through an aperture 180 in forward portion 170. As illustrated in greater detail in FIG. 15, the forward portion 170 has a diameter substantially less than the inside diameter of arrow 150. With the pin 178 biased downwardly in the position of FIG. 15, a lower end 182 of pin 178 extends through an aperture 184 in the arrow 150.

The transmitter assembly 161 is retained within the arrow because the spring means 176 biases the transmitter assembly rearwardly in the direction of arrow 186. The assembly is held within the arrow due to the frictional engagement between the pin lower end 182 and the aperture 184. The frictional engagement therebetween is sufficient to overcome the action of spring 188, which tends to force the pin 178 upwardly.

Figure 15:
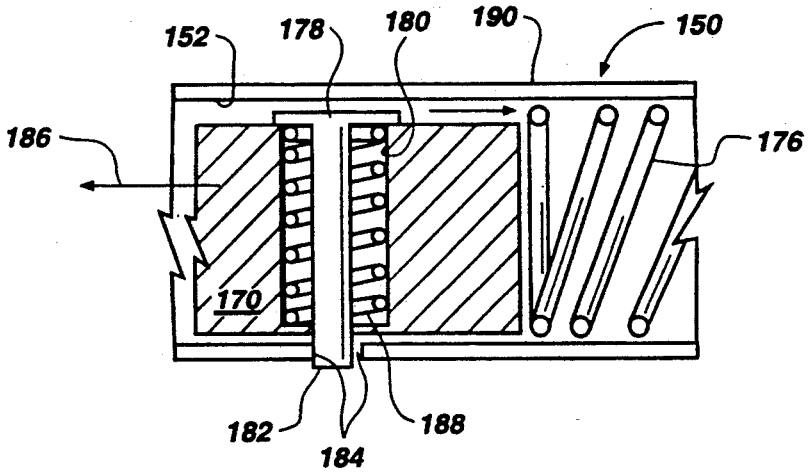
FIG. 15 is an enlarged partial sectional view of the arrow of FIG. 14.

Ejection of the transmitter apparatus of FIGS. 13–15 occurs as follows. After the arrow impacts the target animal, the forward motion of the arrow obviously is immediately and dramatically decreased. The unsecured transmitter assembly 161 within the arrow continues to move forward in the direction of arrow 190, compressing the spring means 176. Slight forward movement of the assembly, including the pin 178, releases the frictional engagement between lower end 182 and aperture 184, thereby permitting the compressed spring 188 to expand and withdraw the lower end 182 of pin 178 from aperture 184. Simultaneously, the attaching means 168 is embedded in the target animal's hide, as illustrated in from aperture 184. As the arrow 150 continues forward, the stationary transmitter assembly 161 is "ejected" or removed from the arrow by sliding it against the ramp 160. Therefore, the arrow may proceed into or through the target animal while the transmitter remains affixed to the hide of the animal, with antenna 166 outside the animal as illustrated in FIG. 11.

Figure 16:
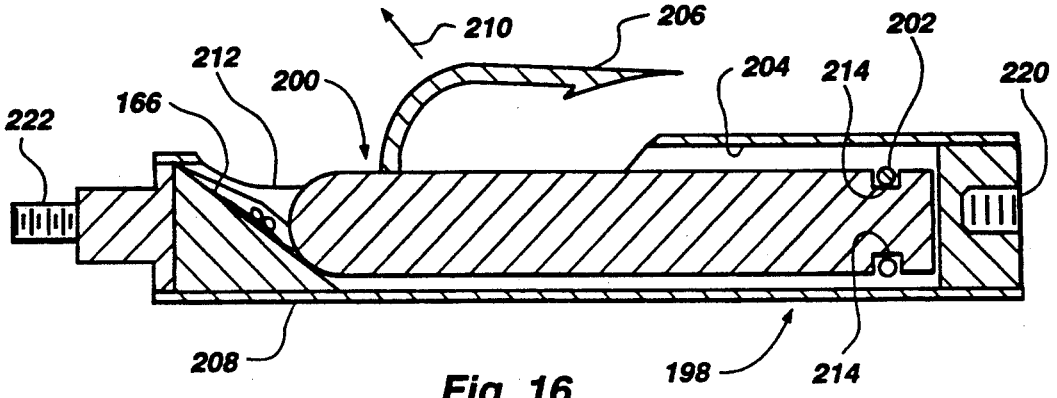
FIG. 16 is a sectional view of another embodiment of the arrow extension.

FIG. 16 illustrates a still further embodiment of the invention wherein arrow extension 198 is provided with a transmitter assembly 200, retaining means such as an O-ring 202 or similar gripping means that frictionally engages the inner arrow chamber wall 204. When arrow 150 penetrates the quarry, the barb 206 embeds in the quarry hide or skin. Engagement of the barb 206 causes assembly 200 to stop, and as the arrow continues through the animal, the assembly 200 slides up ramp 208 in the direction of arrow 210 and exit through window 212. O-ring 202 is retained within slot 214 about assembly 200. The broadhead is affixed to the extension 198 by means of threaded aperture 220, and the extension is affixed to the arrow shaft by threaded member 222.

Figure 17:
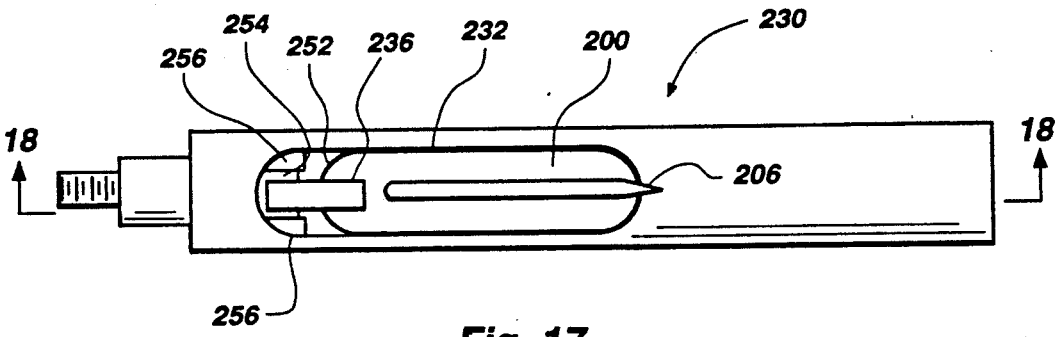
FIG. 17 is a plan view of an further embodiment of the arrow extension.
Figure 18:
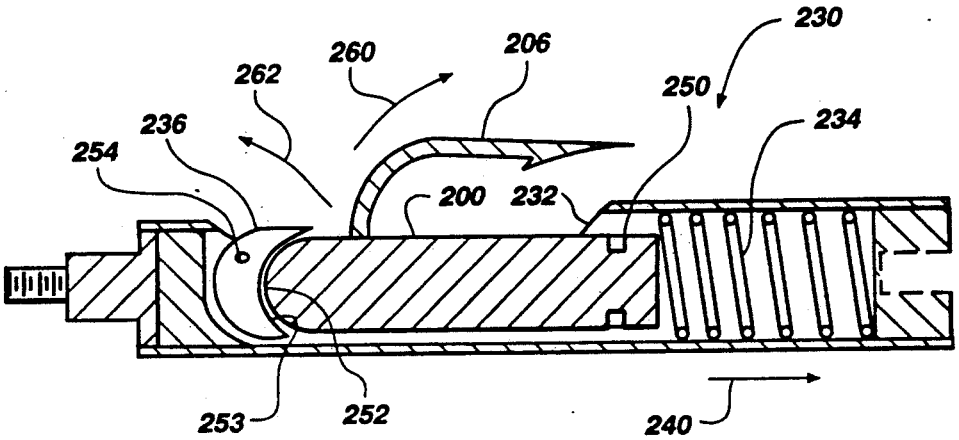
FIG. 18 is a sectional view of the arrow of FIG. 17 taken along lines 18—18.

FIGS. 17 and 18 illustrate a still further embodiment of the invention, wherein the arrow extension 230 retains the transmitter assembly 200 within window 232 by a compression means 234 and an eccentrically mounted cam 236. Compression spring 234 bears against plug 238 and a forward portion 250 of the transmitter assembly 200. The opposite arcuate end 252 of transmitter assembly 200 bears against a mated arcuate surface 253 of cam 236. The cam 236 is rotatably secured to extension 230 by eccentrically located pin 254 to portion 256 secured within the arrow.

Ejection of the transmitter assembly 200 occurs upon arrow impact with a target. Deceleration of arrow and arrow extension 230 causes continued forward motion of assembly 200 compressing spring 234 as shown at arrow 240. Simultaneously, the barb 206 embeds in the hide of the target animal, forcing the rearward portion of the transmitter assembly 200 "upwardly" or outwardly through window 232, in the direction of arrow 260. Cam 236 rotates in the direction of arrow 262 due to the eccentric location of the pin 254. The arrow may proceed through the target animal while the transmitter assembly 200 remains affixed to the animal as illustrated in FIG. 11*d*.

Figure 19:
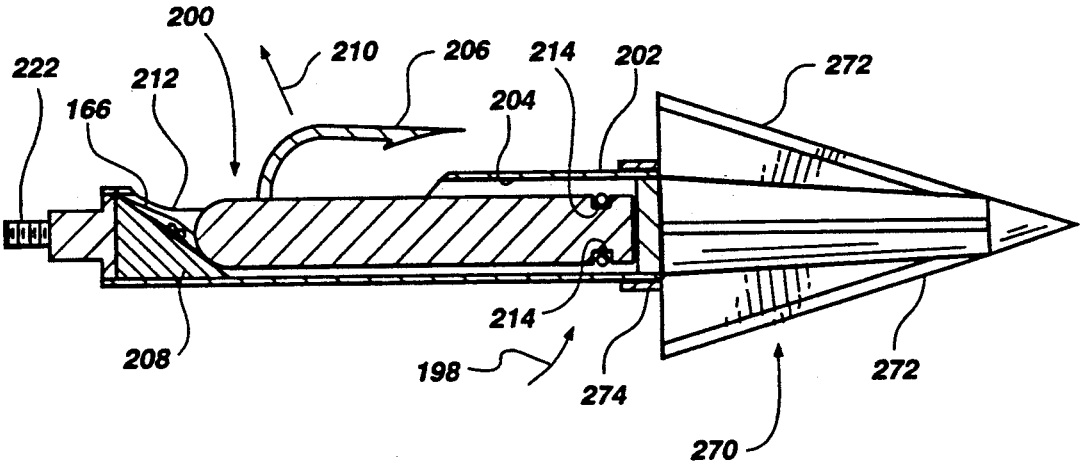
FIG. 19 is a partial section-elevation view of a further embodiment of the arrow extension and broadhead.

FIG. 19 illustrates in partial section a preferred embodiment, where the arrow extension 198 is securely affixed to the broadhead 270. The broadhead blades 272 are clamped to the arrow extension 198 by typical clamp ring means 274, well known to those skilled in the art. This embodiment utilizes the same components as FIG. 16, except that it eliminates threaded connections at 220 (FIG. 16).

Figure 20:
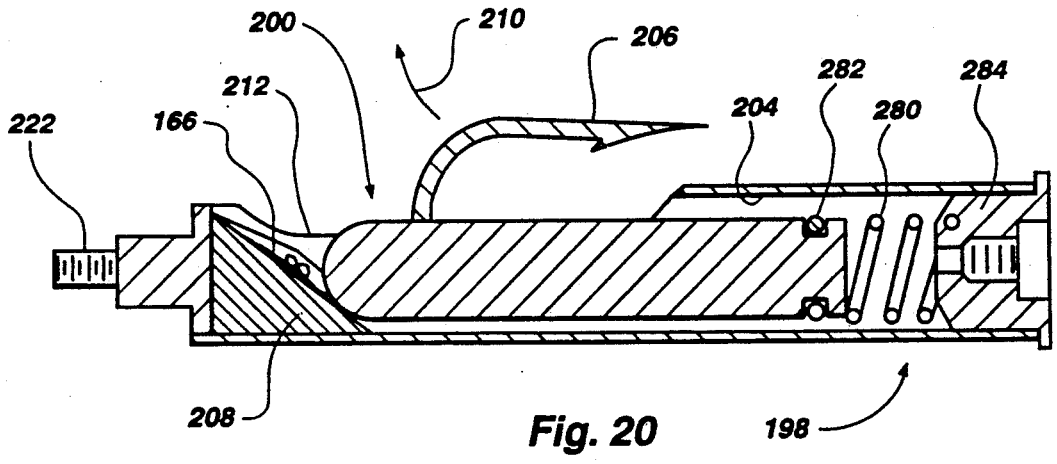
FIG. 20 is a partial section-elevation view of a further embodiment of the arrow extension and broadhead.

FIG. 20 illustrates a further embodiment of extension 198 similar to FIG. 16, except the O-ring restraining member 202 is replaced by a tension spring 280 that grips a groove 282 on a forward portion of transmitter assembly 200 and attaches to a plug 284 inserted within the arrow chamber wall 204. A force in the direction of arrow 210 causes the spring 280 to slip out of groove 282 and release the transmitter as described above.

Figure 21:
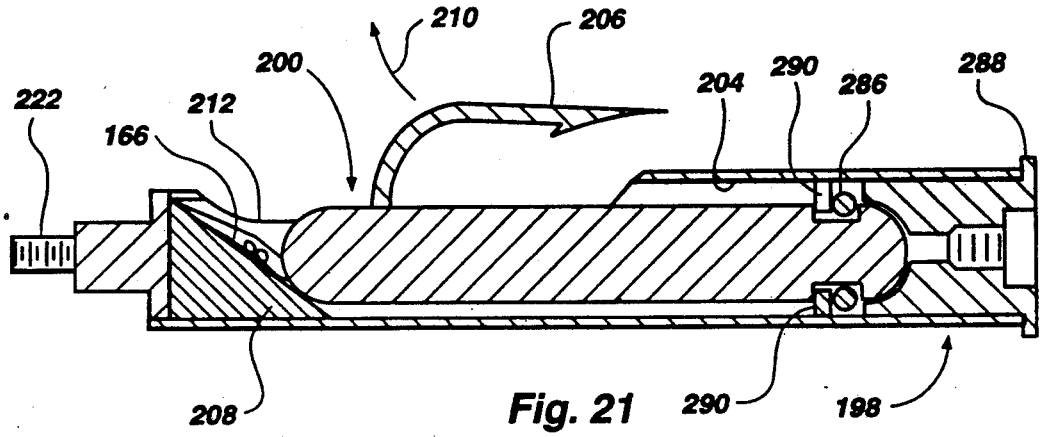
FIG. 21 is a partial section-elevation view of a further embodiment of the arrow extension and broadhead.

A further embodiment similar to the above description is illustrated in FIG. 21. The tension spring 280 (FIG. 20) is replaced by a circular snap ring 286 attached within plug 288. The snap ring 286 is compressed by the chamber wall 204 and engages a somewhat similar circular groove 290 in a forward portion of transmitter assembly 200. The clamping force of the snap ring 286 in groove 290 is overcome by force in direction of arrow 210 as described above releasing the transmitter assembly 200.

Figure 22:
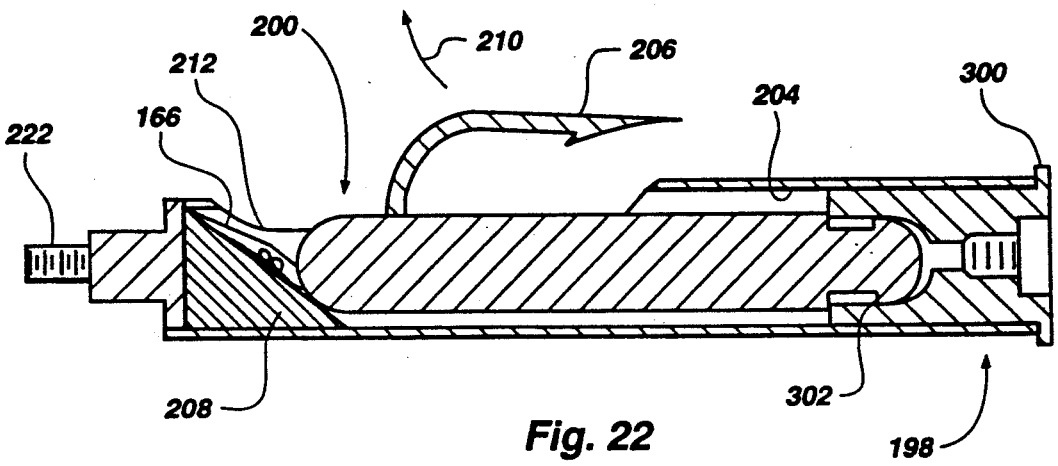
FIG. 22 is a partial section elevation of a final embodiment.

A final embodiment is illustrated in FIG. 22 which is similar to FIG. 21 except that plug 288 (FIG. 21) is replaced by a plastic insert 300 which frictionally engages a head portion 302 of the transmitter 200. The snap ring 286 (FIG. 21) is therefore not required due to the interference fit between a bore of insert 300 and head portion 302. In this case, the clamping force between head 302 and insert 300 is overcome by force in direction of arrow 210 as described above, releasing transmitter assembly 200. Insert 300 is typically made from Delrin TM plastic, having some resilience, good durability and "constant friction" force. Because the extension is less expensive that the longer arrow shaft portion, replacement of the extension is less expensive than replacement of the entire arrow with new fletchings and nock.

It is to be appreciated that in its broadest embodiment, the present invention is not limited to any specific means of placing the transmitter within the hide of the quarry, but encompasses any method whereby an arrow-borne transmitter is affixed to the target animal. The various embodiments have been illustrated herein with barbed hooks—however any means designed to affix the transmitter to the target animal will suffice.

The transmitter is preferably battery-operated and may be actuated either manually at any point prior to shooting the arrow or may be actuated by compression-type switches upon releasing the arrow from the bow or upon impact with the target animal. It would appear that, if cost is no factor, a compression-type switch activated upon releasing the arrow from a drawn bow is preferable since the battery life is conserved until the arrow is actually fired, and the transmitter will be actuated even without sudden impact with the quarry, tree, ground, etc. Alternatively, a compression-type switch which is activated upon impact with the quarry, ground, etc., may be utilized. Likewise, while the figures have illustrated the ejection means in the form of a coiled spring, any means to forcibly and rapidly eject the transmitter from the arrow will suffice, such as leaf springs, etc.

The transmitter should produce a signal which may be received at distances of up to at least two miles. The transmitter may be preset with a code which can be entered into the receiver to ensure picking up only the desired signal, as is commonplace in, for instance, garage door openers.

The antenna may be constructed of any suitably flexible metallic substance capable of functioning as an antenna.

The bow hunter will preferably be provided with a direction-finding receiver 66 having a directional antenna 68. The receiver is tuned to the appropriate preset frequency of the transmitter so that the direction and distance from the transmitter may be calculated and displayed.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

We claim:

1. A hunting arrow having a signal generating transmitter releasably affixed to an external surface of the arrow with tape, said tape having a shear strength less than a force generated by impact of the transmitter with a target animal, and means to affix the transmitter to the animal.

2. A hunting arrow comprising:

a. a forward arrow portion and a rearward arrow portion slidably engaged with one another;

b. a signal generating transmitter located within the rearward portion of the arrow and having a barbed hook extending outside the hunting arrow, such that the hook will affix the transmitter to the hide of the target animal as the arrow enters the animal; and c. an elongated, flexible antenna affixed to the transmitter.

3. A hunting arrow comprising:

a. a broadhead;

b. an arrow extension threadably engaged with the broadhead;

c. signal generating means having an elongate flexible antenna located within a window provided in the extension;

d. a forward-facing barbed hook attached to a forward portion of the signal generating means to securely affix the signal generating means to the hide of a target animal;

e. an arrow portion threadably engaged with the extension;

f. a compression means within the extension bearing against the signal generating means; and g. a spring-loaded pin inserted through the signal generating means frictionally engaging a cooperating aperture in the arrow extension.

4. A hunting arrow comprising:

a. a broadhead;

b. an arrow extension threadably engaged with the broadhead;

c. signal generating means having an elongate flexible antenna located within a window provided in the extension;

d. means to securely affix the signal generating means to the hide of a target animal;

e. an arrow portion threadably engaged with the extension; and wherein the means to affix the signal generating means comprises:

a compression spring bearing against a forward portion of the signal generating means;

an eccentrically pivoted cam bearing against an arcuate end of the transmitter assembly; and a forward-facing barbed hook affixed to a rearward portion of the signal generating means.

5. A hunting arrow comprising:

a. a broadhead;

b. an arrow extension threadably engaged with the broadhead;

c. signal generating means having an elongate flexible antenna located within a window provided in the extension;

d. means to securely affix the signal generating means to the hide of a target animal;

e. an arrow portion threadably engaged with the extension; and wherein the signal generating means is securely retained within the extension by a tension spring fitting within a groove in the forward portion of the signal generating means and attached to a plug affixed within a forward portion of the arrow extension.

6. A hunting arrow comprising:

a. a broadhead;

b. an arrow extension threadably engaged with the broadhead;

c. signal generating means having an elongate flexible antenna located within a window provided in the extension;

d. means to securely affix the signal generating means to the hide of a target animal;

e. an arrow portion threadably engaged with the extension; and wherein the signal generating means is securely retained within the extension by a snap ring bearing against a groove in a forward portion of the transmitter assembly and contained by a plug secured within a forward portion of the arrow extension.

7. A hunting arrow comprising:

a. a broadhead;

b. an arrow extension threadably engaged with the broadhead;

c. signal generating means having an elongate flexible antenna located within a window provided in the extension;

d. means to securely affix the signal generating means to the hide of a target animal;

e. an arrow portion threadably engaged with the extension; and wherein the signal generating means is securely retained within the extension by an interference fit between a head portion of the signal generating means and a bore of a plastic insert affixed within a forward portion of the arrow extension.

* * * * *